US006853359B2

(12) United States Patent
Hashimoto

(10) Patent No.: US 6,853,359 B2
(45) Date of Patent: Feb. 8, 2005

(54) DATA CONVERSION METHOD FOR DISPLAYING AN IMAGE

(75) Inventor: Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 107 days.

(21) Appl. No.: 09/804,033

(22) Filed: Mar. 13, 2001

(65) Prior Publication Data

US 2002/0060652 A1 May 23, 2002

(30) Foreign Application Priority Data

Oct. 18, 2000 (JP) ..... 2000-317321

(51) Int. Cl.[7] ..... G09G 3/28
(52) U.S. Cl. ..... 345/63; 345/60
(58) Field of Search ..... 345/60, 63, 88, 345/596, 89, 99, 87, 90, 690, 94–100, 432, 474, 475; 327/111; 382/251, 270, 274; 348/806

(56) References Cited

U.S. PATENT DOCUMENTS 4,827,516 A * 5/1989 Tsukahara et al. ..... 704/224
5,016,095 A * 5/1991 Kii ..... 348/806
5,739,804 A * 4/1998 Okumura et al. ..... 345/99
5,844,534 A * 12/1998 Okumura et al. ..... 345/90
5,907,316 A * 5/1999 Mikoshiba et al. ..... 345/596
5,920,299 A * 7/1999 Ohshima et al. ..... 345/88
5,994,929 A * 11/1999 Sano et al. ..... 327/111
6,014,121 A * 1/2000 Aratani et al. ..... 345/89
6,127,992 A * 10/2000 Sano ..... 345/60
6,249,265 B1 * 6/2001 Tajima et al. ..... 345/63
6,459,817 B1 * 10/2002 Matsushiro ..... 382/251
6,466,685 B1 * 10/2002 Fukui et al. ..... 382/115
6,552,701 B1 * 4/2003 Tanaka ..... 345/63
6,556,180 B1 * 4/2003 Furuhashi et al. ..... 345/87
2003/0222980 A1 * 12/2003 Miyagaki et al. ..... 348/115

FOREIGN PATENT DOCUMENTS

| | | | |
|---|---|---|---|
| EP | 0884717 | 12/1998 | |
| EP | 0947976 | 10/1999 | |
| EP | 1233395 | 8/2002 | |
| EP | 1288893 | 3/2003 | |
| JP | 10-307561 | 11/1998 | |
| JP | 11-224074 | * 8/1999 | ..... 345/60 |

OTHER PUBLICATIONS

French Preliminary Search Report dated Jul. 15, 2004.

* cited by examiner

*Primary Examiner*—Vijay Shankar
*Assistant Examiner*—Parbodh M. Dharia
(74) *Attorney, Agent, or Firm*—Staas & Halsey LLP

(57) ABSTRACT

A data conversion method for displaying an image is provided in which selection of a subframe expression for reducing pseudo contours is systematized, and the subframe expression is optimized automatically. The method comprises the steps of determining a light emission waveform in accordance with display frame data of plural frames containing the current frame and the previous frame, performing Fourier expansion of an error between the determined light emission waveform and a target light emission waveform defined by the original frame data corresponding to the determined light emission waveform, and setting the display frame data of the current frame so that a sum of error components with weights that are obtained by weighting each Fourier component.

23 Claims, 5 Drawing Sheets

DATA CONVERSION METHOD FOR DISPLAYING AN IMAGE

BACKGROUND OF THE INVENTION

1. Field of the Invention

The present invention relates to a data conversion method for displaying an image with gradation by controlling a light emission time per one frame and a display device that uses the method. The invention is suitable for a plasma display panel (PDP).

A PDP has both a high speed property and a high resolution necessary for a large screen display device of a TV set or a monitor display of a computer. One of the tasks of developing such a PDP is to reduce pseudo contours in displaying a moving image.

2. Description of the Prior Art

A half tone is reproduced in a PDP by setting the number of discharges of each cell (each display element) for one frame in accordance with a gradation level. A color display is one type of the gradation display, and a display color is determined by combination of luminance values of the three primary colors.

A gradation display method for a PDP is known, in which one frame is made of plural subframes having weights of luminance, and the total number of discharges of one frame is set by combining lighting and non-lighting of each subframe (referred to as a subframe expression). In general, conversion of a frame into subframes is performed by using a conversion table that is prepared in advance. Furthermore, in the case of an interlace display, each field of a frame includes plural subfields, and each subfield is controlled for lighting. However, the lighting control is the same as that of a progressive display.

In a display using a light control of subframe unit, lighted subframes and non-lighted subframes are mixed so that light emissions occur at discrete timings in the frame period. Thus, a pseudo contour can be generated. A pseudo contour is a phenomenon in which an observer sees light and shade different from the display contents, and can be generated easily when a portion of an image having pixels of similar gradation levels constituting a gentle gradation change moves in a screen. For example, in a scene with a walking human body, a pseudo contour can occur in a face of the human.

Conventionally, a method of reducing pseudo contours is known in which the weighting is devised so that plural subframe expressions are possible for a half tone, and an optimum subframe expression is selected for each gradation level by noting each frame. A basic rule of optimizing the subframe expression is to stabilize the light emission barycenter in a frame period regardless of the gradation level as disclosed in Japanese unexamined patent publication No. 10-307561. For example, the light emission barycenter is set to be always in the middle of the frame period. If the light emission barycenter is constant, an interval of the light emission barycenter between frames becomes constant, so that a deviation of the light emission timing such as a long period of low luminance can be eliminated.

Moreover, Japanese unexamined patent publication No. 11-224074 discloses a method of selecting an optimum subframe expression, in which a frame to be converted into subframes (referred to as a current frame) is given a subframe expression by referring to a subframe expression of the previous frame and considering the relationship between the previous frame and the current frame. This method can reduce pseudo contours more securely than the method of determining the subframe expression by noting only the current frame.

Conventionally, it is necessary that a skilled person decides a subframe expression to be selected for each gradation level based on the person's experience when making a conversion table for coordinating a frame and subframes in order to reduce pseudo contours substantially. Especially, if the relationship between the previous frame and the current frame is considered as mentioned above, an optimum subframe expression should be determined for each of $256^2$ combinations of gradation when the number of gradation N equals to 256, so a vast labor is necessary. In addition, if two or more previous frames should be referred to, the number of combinations of gradation is up to $N^3$. If a specification is revised by increasing the number of gradation N or changing the weighting, the bothersome job is necessary.

SUMMARY OF THE INVENTION

An object of the present invention is to regulate selection of a subframe expression for reducing pseudo contours, and to realize optimizing the subframe expression by an automatic process.

In the present invention, Fourier component of an error between a light emission waveform depending on a subframe expression and an ideal light emission waveform is evaluated, and a subframe expression having the minimum error is selected from options of the subframe expression. Since a time resolution of a human sense of sight has difficulty in discriminating a higher order of Fourier component, the error is evaluated by weighting each order of the Fourier component.

In the evaluation of an error by Fourier expansion, a time range of the expansion can be set arbitrarily. Therefore, a period of a display frame can be different from a period of an original frame. Moreover, since an ideal waveform to be a target can be set arbitrarily, the target is not limited to a step waveform that indicates a change of discrete target values simply, but can be a line graph waveform connecting target values with lines or an envelope waveform connecting target values with a smooth curve. In other words, target values are not necessarily constant in an original frame period, but can be altered in the original frame period.

DESCRIPTION OF THE PREFERRED EMBODIMENTS

Hereinafter, the present invention will be explained more in detail with reference to embodiments and drawings.

Figure 1:
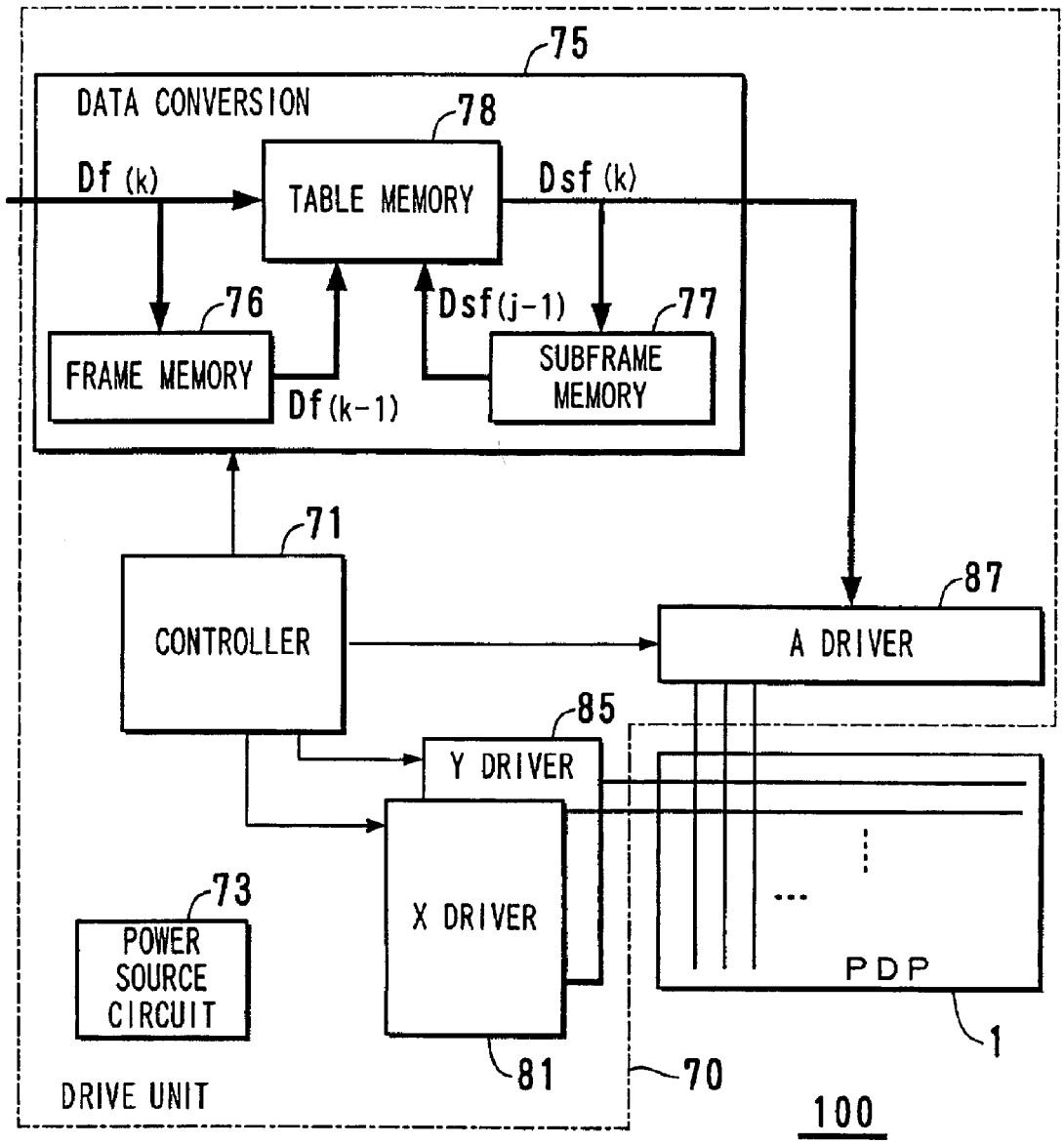
FIG. 1 is a block diagram of a display device according to the present invention.

FIG. 1 is a block diagram of a display device according to the present invention.

The display device 100 comprises a surface discharge type PDP 1 including a display surface having m×n cells, and a drive unit 70 for controlling cells arranged in a matrix to emit light selectively. The display device 100 is used as a wall-hanging TV set or a monitor display of a computer system.

PDP 1 has display electrodes constituting electrode pairs for generating display discharges arranged in parallel and address electrodes arranged to cross the display electrodes. The display electrode extends in the row direction (horizontal direction) of the screen, and the address electrode extends in the column direction (vertical direction).

The drive unit 70 includes a controller 71, a power source circuit 73, a data converting circuit 75, an X driver 81, a Y driver 85, and an A driver 87. The drive unit 70 is supplied with frame data Df, i.e., multivalue image data indicating luminance levels of red, green and blue colors together with various synchronizing signals from external equipment such as a TV tuner or a computer.

In a display including a PDP 1, an original frame of an input image is divided into a predetermined number M of subframes so as to reproduce gradation by binary control of lighting. The data converting circuit 75 converts the frame data Df into subframe data Dsf for the gradation display and transmits the data to the A driver 87. The subframe data Dsf are a set of display data for M screens containing one bit per cell, and the value of each bit indicates whether the cell of the corresponding subframe is to be lighted, more specifically whether an address discharge is necessary. The data converting circuit 75 includes a frame memory 76 for memorizing frame data Df of at least one frame, a subframe memory 77 for memorizing subframe data Dsf of at least one frame, and a table memory 78 for outputting subframe data Dsf in a method of looking up. The table memory 78 is supplied with latest frame data Df, frame data Df delayed by the frame memory 76, and subframe data Dsf delayed by the subframe memory 77. When converting the frame data Df of the k-th frame to be displayed into the subframe data Dsf, the frame data Df of the previous frame including the (k−1)th frame and the subframe data Dsf are referred to for selecting an optimum subframe expression. The data of the table memory 78 are set so that Fourier component of an error from a target becomes the minimum according to the present invention. Furthermore, an arithmetic processor may be provided instead of the table memory 78, so that an optimum subframe expression can be determined by Fourier operation responding to an input.

Figure 2:
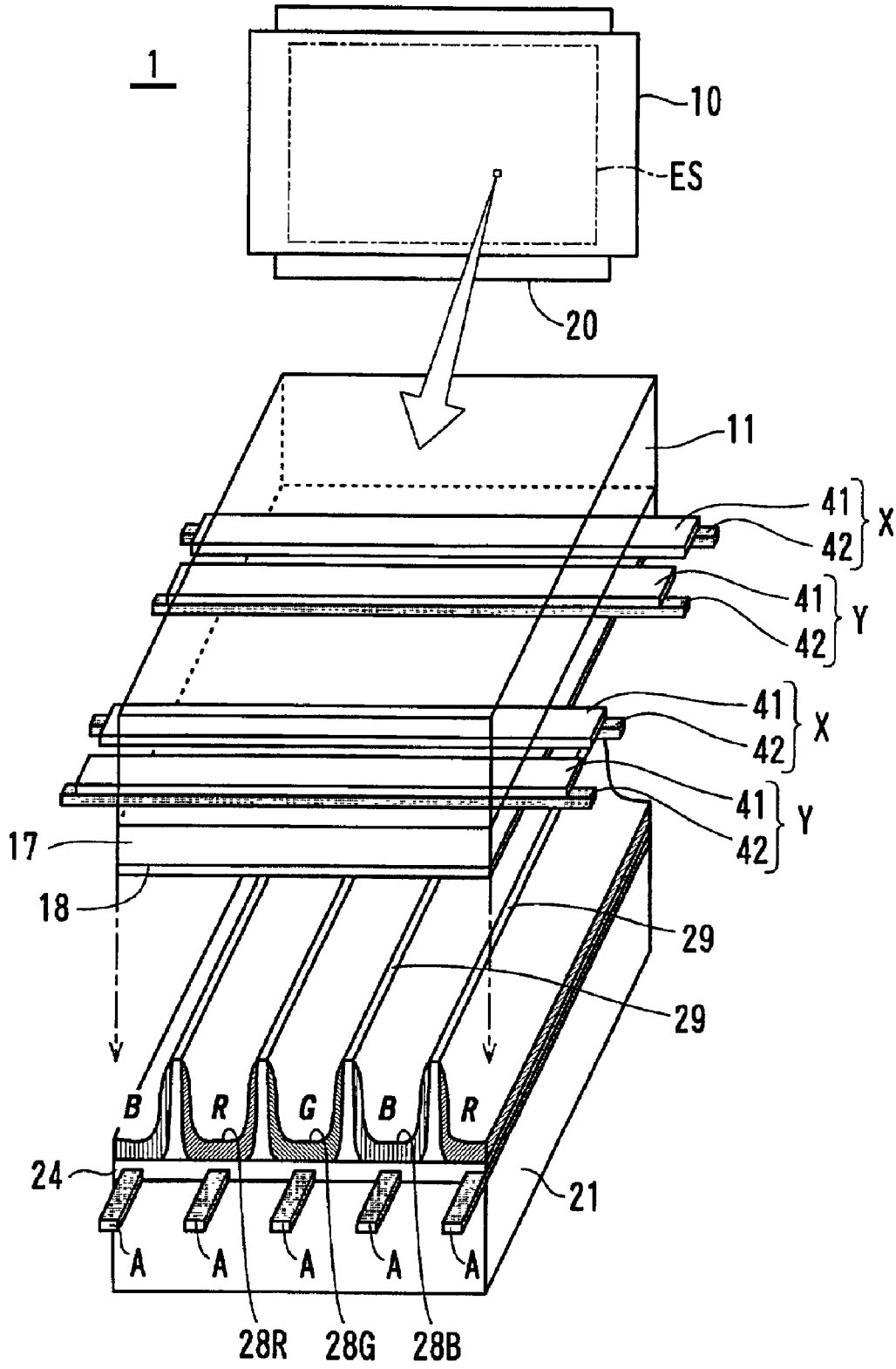
FIG. 2 shows an example of a cell structure of a PDP.

FIG. 2 shows an example of a cell structure of a PDP.

As shown in FIG. 2, the PDP 1 comprises a pair of substrate structures (each structure made of a substrate on which cell elements are arranged) 10 and 20. On the inner side of a glass substrate 11 of a front substrate structure 10, a pair of display electrodes X and Y is arranged for reach row of the display surface ES having n rows and m columns. Each of the display electrodes X and Y includes a transparent conductive film 41 that forms a surface discharge gap and a metal film 42 that is overlapped on the edge portion of the transparent conductive film 41. The display electrodes X and Y are covered with a dielectric layer 17, which is coated with a protection film 18.

On the inner side of the rear glass substrate 21, the address electrodes A are arranged, one for a column. The address electrodes A are covered with a dielectric layer 24. On the dielectric layer 24, a partition 29 having a height of approximately 150 μm is provided. A pattern of the partition is a stripe pattern that divides a discharge space into columns. The surface of the dielectric layer 24 and the side face of the partition 29 are covered with fluorescent material layers 28R, 28G, and 28B for color display. Italic letters (R, G and B) in FIG. 2 indicate light emission colors of the fluorescent materials. The color arrangement has a repeating pattern of red, green and blue colors in which cells in each column have the same color. The fluorescent material layers 28R, 28G and 28B are excited locally by ultraviolet rays generated by a discharge gas and emit light.

Figure 3:
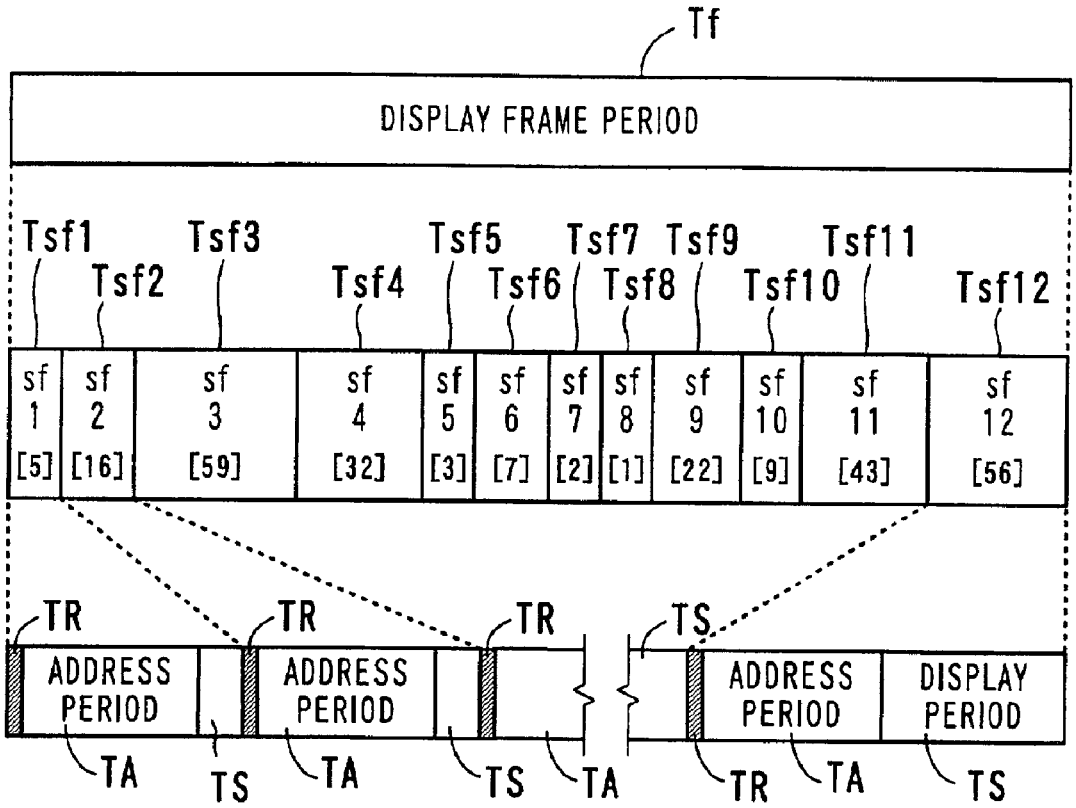
FIG. 3 shows a scheme of dividing a frame.
Figure 4:
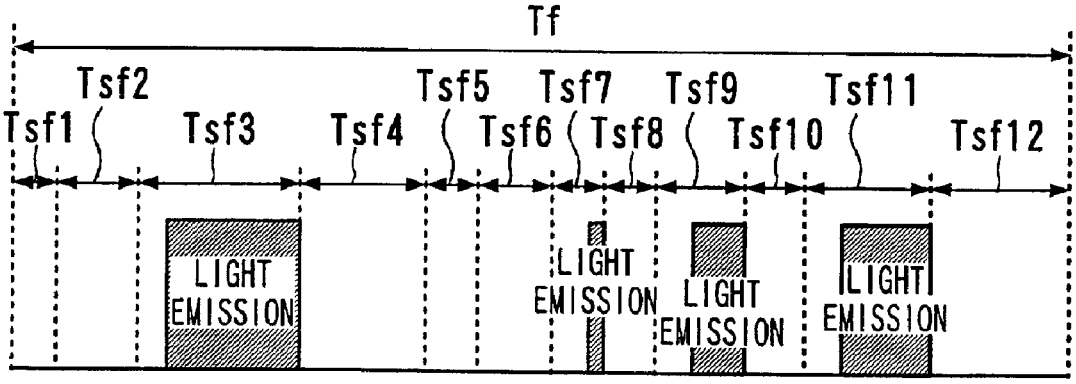
FIG. 4 shows an example of a light emission pattern.

FIG. 3 shows a scheme of dividing a frame. FIG. 4 shows an example of a light emission pattern.

In order to reproduce a color by gradation display for each color, a frame is divided into e.g., twelve subframes. Namely, a frame is replaced with a set of twelve subframes sf1–sf12. Weighting is performed for setting the display discharge of each subframe, so that a ratio of luminance values of the subframes is approximately 5:16:59:32:3:7:2:1:22:9:43:56. Combinations of lighting and non-lighting of each subframe can make 256 steps of luminance setting for each of red, green and blue colors.

The display frame period Tf is divided into subframe periods Tsf1–Tsf12 assigned to the subframes. Each of the subframe period Tsf1–Tsf12 is divided into a preparation period TR for equalizing charge distribution in the whole screen, an address period TA for forming an electrification distribution corresponding to display contents, and a display period TS for sustaining the lighted state so as to ensure a luminance corresponding to a gradation level. Lengths of the preparation period TR and the address period TA are constant regardless of the weight of luminance, and a length of the display period TS is larger for a larger weight of luminance.

As shown in FIG. 4, in a display of the gradation level 126 (=59+2+22+43), the subframe expression is selected for lighting four subframes sf3, sf7, sf9 and sf11.

Hereinafter, a data conversion method for optimizing the subframe expression will be explained.

EXAMPLE 1

Here, one cell is noted, and the relationship between the cell and each of the surrounding cells is not considered.

Figure 5:
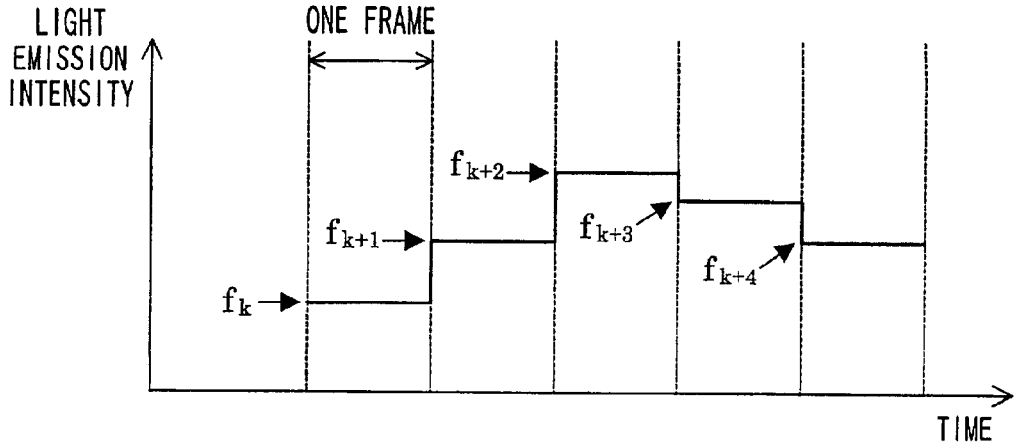
FIG. 5 shows a target light emission waveform of type A.

The luminance level to be displayed is denoted by $f_k$. The variable k indicates the number of frame. The target waveform is a step waveform shown in FIG. 5. The form in which a target value does not change within one frame is called "type A".

The light emission intensity of the i-th subframe in the k-th frame is denoted by $\eta^k_i$, a start point of a display period is denoted by $\alpha^k_i$, and an end point thereof is denoted by $\beta^k_i$. A unit of the time axis is a frame period, and origins of $\alpha^k_i$ and $\beta^k_i$ are set at the head of the k-th frame. Furthermore, concerning $\eta^k_i$, all frames have the same subframe structure, and the luminance level when only the i-th subframe is lighted is denoted by $f_{SF}{}^k{}_i$. Then, the luminance level $f_{SP}{}^k{}_i$ is standardized by the following equation.

$$f_{SF}{}^k{}_i=\eta^k_i(\beta^k_i-\alpha^k_i) \quad (1)$$

If the period of the display discharge does not change depending on a subframe, $\eta^k_i$ is also independent of a subframe and is substantially a constant value. In addition, the subframe structure can be different for each frame. The expansion into Fourier series is performed in a period of successive L frames. A point on the time axis having a unit of frame period is denoted by t, and the origin is set to the head of 0-th frame. Then, a fundamental function system is expressed as follows.

$$\left\{\frac{1}{2}, \cos 2n\pi\frac{t}{L}, \sin 2n\pi\frac{t}{L}\right\} \tag{2}$$

The same fundamental function system is used without depending on a period to be expanded. Here, n is a natural number. The light emission pattern of subframes of the k-th frame is determined so that an error between the light emission waveform and the target light emission waveform is minimized. Then, the error is evaluated by weighting components of Fourier expansion of the difference between the light emission waveform and the target light emission waveform in a period that is L frames before the k-th frame.

When the light emission waveform is denoted by $\phi(t)$ and the target light emission waveform is denoted by f(t), Fourier expansion of an error in the period of L frames is derived by the following equation.

$$\phi(t) - f(t) = \frac{a_0}{2} + \sum_{n=1}^{\infty}\left(a_n\cos 2n\pi\frac{t}{L} + b_n\sin 2n\pi\frac{t}{L}\right) \tag{3}$$

Here, the coefficients are as follows.

$$a_n = \frac{2}{L}\int_{k-L+1}^{k+1}(\phi(t) - f(t))\cos 2n\pi\frac{t}{L}\,dt \quad (n = 0, 1, 2, \ldots)$$
$$b_n = \frac{2}{L}\int_{k-L+1}^{k+1}(\phi(t) - f(t))\sin 2n\pi\frac{t}{L}\,dt \quad (n = 1, 2, \ldots) \tag{4}$$

Since the fundamental function system is fixed, the integral period in the equation (4) can be divided into each frame period, and the sum can be calculated later. The integral of each frame is defined as follows.

$$a_n^k = \frac{2}{L}\int_{k}^{k+1}(\phi(t) - f(t))\cos 2n\pi\frac{t}{L}\,dt \quad (n = 0, 1, 2, \ldots)$$
$$b_n^k = \frac{2}{L}\int_{k}^{k+1}(\phi(t) - f(t))\sin 2n\pi\frac{t}{L}\,dt \quad (n = 1, 2, \ldots) \tag{5}$$

Using the equations (5), the coefficients defined by the equations (4) are rewritten as follows.

$$a_n = \sum_{j=k-L+1}^{k} a_n^j$$
$$b_n = \sum_{j=k-L+1}^{k} b_n^j \tag{6}$$

Next, the integrals of the equations (5) are calculated. First, the lighting pattern of subframes in k-th frame is denoted by $\delta^k(i)$. If the i-th subframe is lighted, $\delta^k(i)=1$. If the i-th subframe is not lighted, $\delta^k(i)=0$. In addition, a function $S_{\alpha,\beta}(t)$ is used that has the value "1" in the period from $\alpha$ to $\beta$ and the value "0" in the other period. Then, $\phi(t)$ in the period of k-th frame can be expressed as follows.

Function: $S_{\alpha,\beta}(t)$ $$\phi(t) = \sum_{i=1}^{M_k}\delta^k(i)\eta_i^k S_{k+\alpha_i^k, k+\beta_i^k}(t) \tag{7}$$

Here, $M_k$ is the total number of subframes in the k-th frame. In the k-th frame period, f(t) is expressed as follows.

$$f(t)=f_k \tag{8}$$

Therefore, the following equations are derived.

$$a_0^k = \frac{2}{L}\sum_{i=1}^{M_k}\delta^k(i)\eta_i^k(\beta_i^k - \alpha_i^k) - \frac{2}{L}f_k \tag{9}$$

$$a_n^k = \left(\frac{1}{n\pi}\right)\sum_{i=1}^{M_k}\delta^k(i)\eta_i^k\left(\sin\frac{2n\pi}{L}(k+\beta_i^k) - \sin\frac{2n\pi}{L}(k+\alpha_i^k)\right) - \left(\frac{1}{n\pi}\right)f_k\left(\sin\frac{2n\pi}{L}(k+1) - \sin\frac{2n\pi}{L}k\right) \quad (n = 1, 2, \ldots)$$

$$b_n^k = -\left(\frac{1}{n\pi}\right)\sum_{i=1}^{M_k}\delta^k(i)\eta_i^k\left(\cos\frac{2n\pi}{L}(k+\beta_i^k) - \cos\frac{2n\pi}{L}(k+\alpha_i^k)\right) + \left(\frac{1}{n\pi}\right)f_k\left(\cos\frac{2n\pi}{L}(k+1) - \cos\frac{2n\pi}{L}k\right) \quad (n = 1, 2, \ldots)$$

From the equations (9) and (6), Fourier coefficients are obtained.

Hereinafter, an error of the light emission distribution that is sensed by human eyes is discussed. A sensitivity of human eyes (or a quantity proportional to the sensitivity) for each frequency of Fourier components is denoted by $\xi_n$. Then, the error with weight $\xi_n$ of the light emission waveform in the period of L frames that can be sensed by human eyes is as follows.

$$E_h(t) = \xi_0\left(\frac{a_0}{2}\right) + \sum_{n=1}^{\infty}\xi_n\left(a_n\cos 2n\pi\frac{t}{L} + b_n\sin 2n\pi\frac{t}{L}\right) \tag{10}$$

A square average of this error within the period of L frames is calculated as follows.

$$E_L = (\xi_0)^2\left(\frac{a_0}{2}\right)^2 + \sum_{n=1}^{\infty}(\xi_n)^2((a_n)^2 + (b_n)^2) \tag{11}$$

When the lighting pattern $\delta^k(i)$ of the k-th frame is determined, in the equation (11), other quantities than the lighting pattern of the k-th frame are known. The lighting pattern of the k-th frame is determined so that the error $E_L$ with weight is minimized. The expression of $E_L$ is organized by the unknown variable $\delta^k(i)$ to be rewritten as follows.

$$E_L = \sum_{i=1}^{M_k}G_i^k\delta^k(i) + \sum_{i<j}H_{i,j}^k\delta^k(i)\delta^k(j) + Q_k \tag{12}$$

Here, $G^k_i$, $H^k_{i,j}$ and $Q^k$ are known quantities as expressed below.

$$G_i^k = (\xi_0)^2\left(\frac{1}{L^2}(\eta_i^k)^2(S_i^k)^2 + \frac{a_0'}{L}\eta_i^k S_i^k\right) + \tag{13}$$

-continued $$\sum_{n=1}^{\infty}(\xi_n)^2\left[\begin{array}{c}2\left(\frac{1}{n\pi}\right)^2(\eta_i^k)^2\left(1-\cos\frac{2n\pi}{L}S_i^k\right)+\\4\left(\frac{1}{n\pi}\right)\eta_i^k\left(\begin{array}{c}a_n'\cos\frac{2n\pi}{L}(k+P_i^k)\sin\frac{2n\pi}{L}S_i^k+\\b_n'\sin\frac{2n\pi}{L}(k+P_i^k)\cos\frac{2n\pi}{L}S_i^k\end{array}\right)\end{array}\right]$$

$$H_{i,j}^k=2(\xi_0)^2\frac{1}{L^2}\eta_i^k\eta_j^kS_i^kS_j^k+\sum_{n=1}^{\infty}8(\xi_n)^2\left(\frac{1}{n\pi}\right)^2\eta_i^k\eta_j^k\times$$

$$\left[\begin{array}{c}\cos\frac{2n\pi}{L}(k+P_i^k)\cos\frac{2n\pi}{L}(k+P_j^k)\sin\frac{2n\pi}{L}S_i^k\sin\frac{2\pi n}{L}S_j^k+\\\sin\frac{2n\pi}{L}(k+P_i^k)\sin\frac{2n\pi}{L}(k+P_j^k)\cos\frac{2n\pi}{L}S_i^k\cos\frac{2n\pi}{L}S_j^k\end{array}\right]$$

$$Q=(\xi_0)^2\left(\frac{a_0'}{2}\right)^2+\sum_{n=1}^{\infty}(\xi_n)^2((a_n')^2+(b_n')^2)$$

The coefficients are defined as follows.

$$S^k{}_i=\beta^k{}_i-\alpha^k{}_i$$

$$P_i^k=\frac{1}{2}(\alpha_i^k+\beta_i^k) \tag{14}$$

$$a_0'=\sum_{j=k-L+1}^{k-1}a_0^j-\frac{2}{L}f_k$$

$$a_n'=\sum_{j=k-L+1}^{k-1}a_n^j-\left(\frac{1}{n\pi}\right)f_k\left(\sin\frac{2n\pi}{L}(k+1)-\sin\frac{2n\pi}{L}k\right)$$

$$(n=1,2,\ldots)$$

$$b_n'=\sum_{j=k-L+1}^{k-1}b_n^j-\left(\frac{1}{n\pi}\right)f_k\left(\cos\frac{2n\pi}{L}(k+1)-\cos\frac{2n\pi}{L}k\right)$$

$$(n=1,2,\ldots)$$

Consequently, since the light emission pattern of a new frame is determined in accordance with the light emission pattern of the previous frame and display luminance, the relationship therebetween may be calculated beforehand to be a table.

As explained above, an error is evaluated not by a display gradation level but by a display luminance. It is because that one display gradation level can generate different luminance levels depending on a display load. If the variation of the display load is not substantially large, an error can be evaluated not by a waveform of the light emission intensity but by a waveform of the gradation level (gradation waveform). In this case, in the equations explained above, $\phi(t)$, $f(t)$, $f_k$, $f_{SF}{}^k{}_i$ and $\eta^k{}_i$ denote quantities of the gradation level. A relationship table for determining a new light emission pattern is a table of the relationship between the light emission pattern of the past frame and the display gradation level. This structure can be adopted since it is expected that the rapid change of the display load does not occur frequently. This structure has an advantage in that the relationship table can be compact. In addition, $\xi_n$ can be set in an approximate manner. For example, for Fourier component corresponding to a frequency above the flicker frequency that can be discriminated by human sense about the intensity variation, value of $\xi_n$ can be set as $\xi_n=0$. For Fourier component corresponding to a frequency below the flicker frequency, value of $\xi_n$ can be set as $\xi_n=1$. Since the flicker frequency is lowered for lower luminance level, $\xi_n$ can be a function of the display luminance.

Moreover, a value above the flicker frequency is normally selected for the frame frequency. Therefore, the value of $\xi_n$ can be set to "0" for Fourier component corresponding to a frequency above the frame frequency and to "1" for Fourier component corresponding to a frequency below the same. More specifically, $\xi_n$ is expressed as follows.

$$\xi_n=1\ (n\leqq L-1)$$

$$\xi_n=0\ (n\geqq L) \tag{15}$$

The set value of the weight $\xi_n$ is not limited to the above-mentioned example. For example, $a_0/2$ of the error components is an error of the gradation level. If a faithful reproduction of the gradation level is required, the value of $\xi_0$ is set large. In addition, if a particularly strict faithfulness of the reproduction of the gradation level is required, the light emission pattern is selected as follows.

$$a_0=0 \tag{16}$$

In this case, the structure of the subframe is required to be capable of expressing any gradation level. If there are plural light emission patterns that can express the same gradation level, the light emission pattern that can minimize the error $E_L$ is selected. The intensity of one or more Fourier component is preferably low so that pseudo contours and flickers can be reduced. If an error of the gradation level is permitted to a certain extent, under the condition defined by the expression (17), the light emission pattern can be so determined as to minimize the error $E_L'$ defined by the equation (18).

$$a_0\leqq D \tag{17}$$

$$E_L'=\sum_{n=1}^{\infty}(\xi_n)^2((a_n)^2+(b_n)^2) \tag{18}$$

In this case too, the weight $\xi_n$ is set approximately to "0" for Fourier component above the flicker frequency and to "1" for Fourier component below the same. In addition, a gradation permitted error D can be a function of the display luminance, too. If the error of the gradation is permitted, options for selecting a light emission pattern are increased so that pseudo contours and flickers can be reduced easily. In addition, it is desirable that a user can select whether the conditions defined in expressions (16) and (17) are valid or not, and that a user can adjust the weighting according to the user's preference.

If the condition of the equation (16) is valid, it is necessary that all gradation levels of display data can be displayed. However, an error of the gradation level is permitted in other cases, so the subframe structure that can express all gradation levels is not always necessary. Moreover, the gradation level that can be expressed by a combination of light emission patterns of subframes is usually set to a value of multiple of the minimum gradation level by an integer. However, it is unnecessary for the selection method of the light emission pattern according to the present invention in which an error of the gradation level is permitted. Conventionally, when expressing a gradation level that cannot be expressed by a lighting pattern of subframes, an area gradation method or an interframe modulation method is utilized. However, according to the present invention, the light emission pattern is determined by evaluating an error $E_L$, so that the gradation level to be a target can be automatically displayed without combining another method.

Furthermore, in order to determine the subframe expression of the current frame, the light emission pattern of the previous frame and the display luminance level (or the display gradation level) are used. Therefore, the light emission pattern and the display luminance level (or the display gradation level) for each frame of at least (L-1) frames in the past should be memorized. After the subframe expression of the current frame is determined, the light emission pattern and the display luminance level of the frame are memorized, and old data that are not used for the later calculation are erased.

EXAMPLE 2

Figure 6:
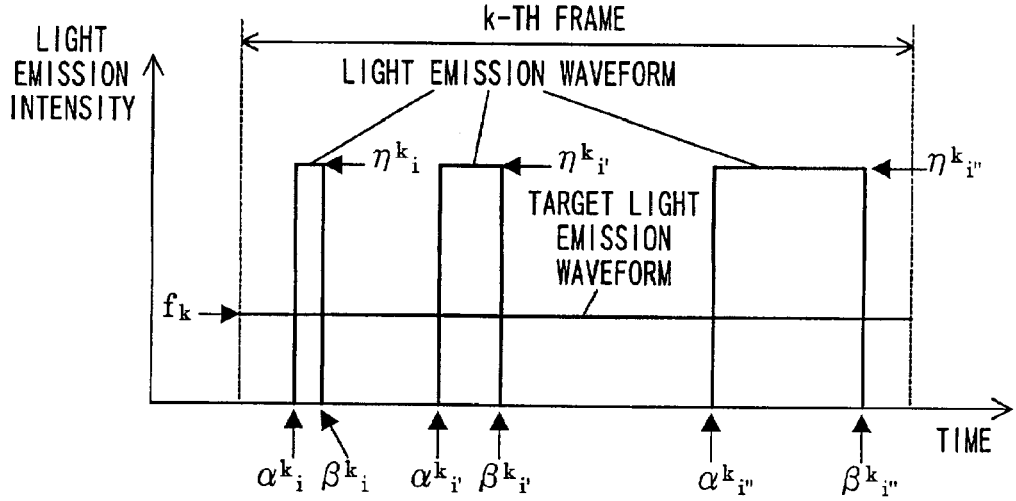
FIG. 6 shows a target light emission waveform of type A and the corresponding light emission waveform.
Figure 7:
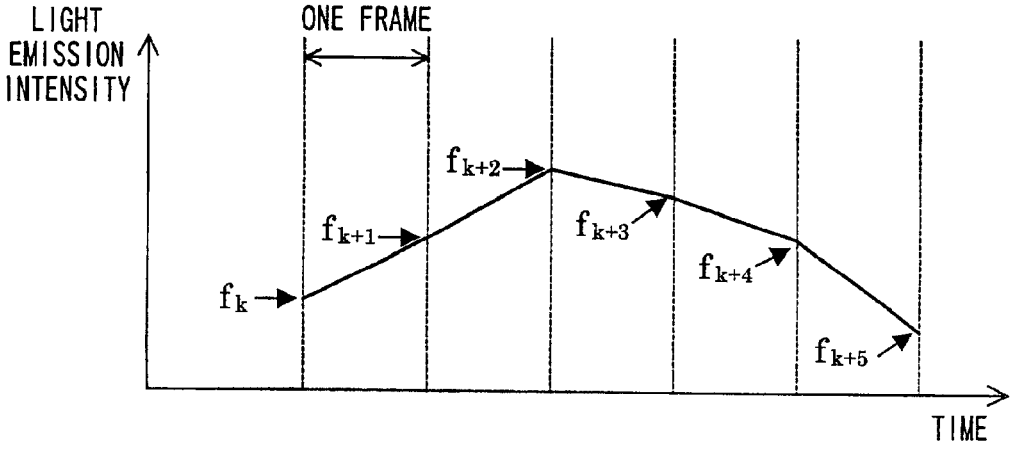
FIG. 7 shows a target light emission waveform of type B.

The light emission intensity distribution as shown in FIG. 6 is a target in Example 1, while a line graph waveform as shown in FIG. 7 can be the target light emission waveform. The form in which a target value changes within one frame is called "type B". The waveform shown in FIG. 7 is a primary interpolation waveform obtained by linear approximation of a target transition within a frame in accordance with a luminance level of each frame. This example is similar to Example 1 except for expressions of Fourier coefficients.

$$f(t)=(f_{k+1}-f_k)(t-k)+f_k \tag{19}$$

The expressions of Fourier components are as follows.

$$a_0^k = \frac{2}{L}\sum_{i=1}^{M}\delta^k(i)\eta_i^k(\beta_i^k-\alpha_i^k)-\frac{1}{L}(f_k+f_{k+1}) \tag{20}$$

$$a_n^k = \left(\frac{1}{n\pi}\right)\sum_{i=1}^{M}\delta^k(i)\eta_i^k\left(\sin\frac{2n\pi}{L}(k+\beta_i^k)-\sin\frac{2n\pi}{L}(k+\alpha_i^k)\right)-\left(\frac{1}{n\pi}\right)\left(f_{k+1}\sin\frac{2n\pi}{L}(k+1)-f_k\sin\frac{2n\pi}{L}k\right)-\left(\frac{L}{2n^2\pi^2}\right)(f_{k+1}-f_k)\left(\cos\frac{2n\pi}{L}(k+1)-\cos\frac{2n\pi}{L}k\right)\ (n=1,2,\ldots)$$

$$b_n^k = -\left(\frac{1}{n\pi}\right)\sum_{i=1}^{M}\delta^k(i)\eta_i^k\left(\cos\frac{2n\pi}{L}(k+\beta_i^k)-\cos\frac{2n\pi}{L}(k+\alpha_i^k)\right)+\left(\frac{1}{n\pi}\right)\left(f_{k+1}\cos\frac{2n\pi}{L}(k+1)-f_k\cos\frac{2n\pi}{L}k\right)-\left(\frac{L}{2n^2\pi^2}\right)(f_{k+1}-f_k)\left(\sin\frac{2n\pi}{L}(k+1)-\sin\frac{2n\pi}{L}k\right)\ (n=1,2,\ldots)$$

Though the expression (13) does not change, a part of the expression (14) changes as the expression of Fourier coefficients changes.

$$a_0' = \sum_{j=k-L+1}^{k-1} a_0^j-\frac{1}{L}(f_k+f_{k+1}) \tag{21}$$

$$a_n' = \sum_{j=k-L+1}^{k-1} a_n^j-\left(\frac{1}{n\pi}\right)\left(f_{k+1}\sin\frac{2n\pi}{L}(k+1)-f_k\sin\frac{2n\pi}{L}k\right)-\left(\frac{L}{2n^2\pi^2}\right)(f_{k+1}-f_k)\left(\cos\frac{2n\pi}{L}(k+1)-\cos\frac{2n\pi}{L}k\right)\ (n=1,2,\ldots)$$

$$b_n' = \sum_{j=k-L+1}^{k-1} b_n^j-\left(\frac{1}{n\pi}\right)\left(f_{k+1}\cos\frac{2n\pi}{L}(k+1)-f_k\cos\frac{2n\pi}{L}k\right)-\left(\frac{L}{2n^2\pi^2}\right)(f_{k+1}-f_k)\left(\sin\frac{2n\pi}{L}(k+1)-\sin\frac{2n\pi}{L}k\right)\ (n=1,2,\ldots)$$

More frame data can be used for interpolation of a higher order.

EXAMPLE 3

In Examples 1 and 2, a response time of the fluorescent material is not considered. However, if the response time of the fluorescent material is long, a frequency response of human eyes is substantially deteriorated. Therefore, the adjustment is performed in order to decrease the value of $\xi_n$ in a high order. In general, the response speed of the fluorescent material depends on a color, so it is desirable that the value of $\xi_n$ is varied depending on a color.

EXAMPLE 4

In Examples 1 and 2, Fourier component in the period of plural frames is considered. However, it is possible to consider Fourier component within one frame, i.e., in the case where L=1. In this case too, a light emission pattern is selected so that the light emission waveform in the frame becomes smooth. Therefore, the state of low luminance level is prevented from lasting long, so that pseudo contours and flickers can be suppressed. The light emission pattern is determined only from the display luminance data of the frame, so the correspondent table becomes compact.

EXAMPLE 5

The period for considering Fourier component is not necessarily constant. If the luminance level or the gradation level alters rapidly, a deviation of the time axis direction distribution of the light emission intensity in the frame, for example, is hardly sensed by human eyes as an abnormal display. Therefore, it is possible to determine the light emission pattern, for example, by setting L to a value of two or more normally, and by setting L to a value of "1" if the difference to the luminance level or the gradation level of the adjacent frame is large to a certain extent.

EXAMPLE 6

Figure 8:
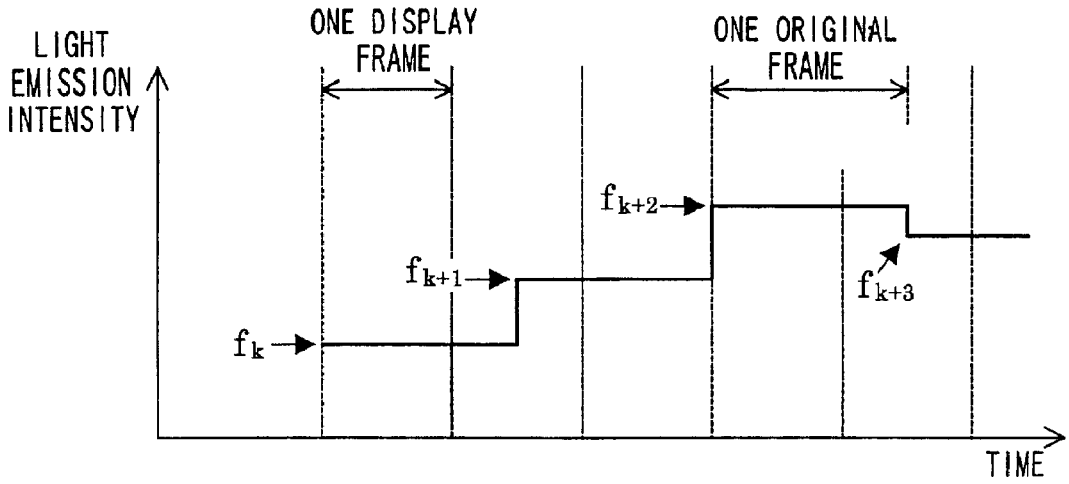
FIG. 8 shows a target light emission waveform of type A when the frame period is different.
Figure 9:
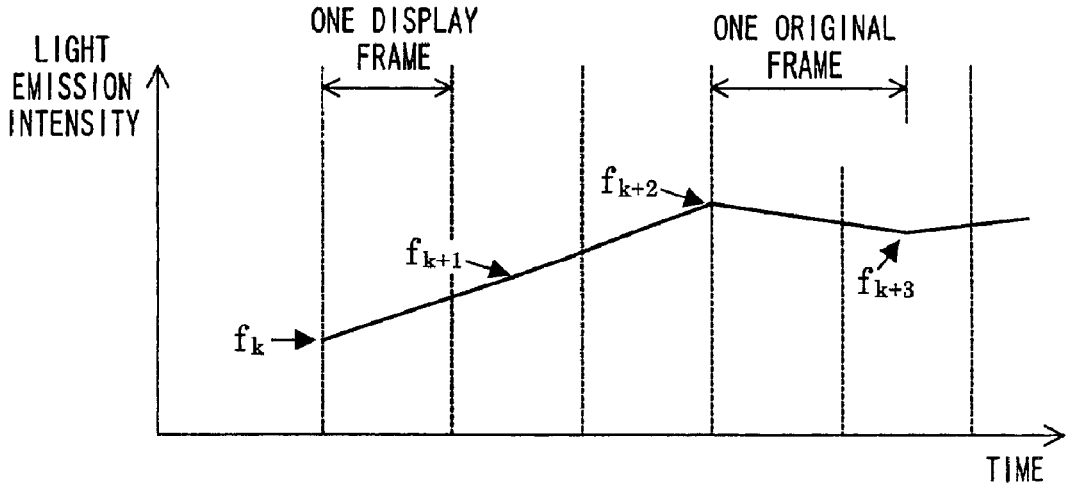
FIG. 9 shows a target light emission waveform of type B when the frame period is different.

The subframe expression can be optimized also in the case where the frame period of the display device 100 (the length of the display frame period) is different from the frame period of the frame data Df that is the original image (the transferring period of the original frame). In this case, the target light emission waveform is defined as shown in FIG. 8 or FIG. 9 for evaluating an error. In this case, the unit of the period of Fourier expansion can be the frame period of the display frame or the frame period of the original frame.

If the frame period of the display frame is adopted as the unit, f(t) is defined in accordance with display data. If the frame period of the original frame is adopted as the unit, subframes within one original frame may be redefined as a set of subframes in the frame.

EXAMPLE 7

If the display device has a structure in which subframe data (a light emission pattern) are received and display is performed in accordance with the received data, the subframe data can be generated beforehand from gradation data of an image, so as to be inputted into the display device. In this way, the display device is not required to determine the light emission pattern, and the circuit structure can be simplified. It is also possible to memorize such light emission pattern data in another memory device, and to reproduce the data in the display device at any time.

In addition, this display device can be a semimanufactured product (a plasma display module) that is combined with another module such as an interface circuit to be a final product. Thus, a manufacturer of the final product can freely coordinate the method of determining the light emission pattern, so that the flexibility of design can be increased.

Moreover, in order to control power consumption of the display device, it is desirable to calculate data of display load data of each frame beforehand and to input them together for saving time and effort of calculating gradation data from light emission pattern data in the display device.

According to the present invention, selection of a subframe expression for reducing pseudo contours can be systematized and the subframe expression can be optimized automatically.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A data conversion method for displaying an image, comprising conversion of original frame data indicating gradation of a pixel into display frame data defining a light emission timing of a display element in a display frame period, the conversion, comprising:

determining a light emission waveform for plural frames in accordance with display frame data of a current frame and display frame data of a previous frame;

performing Fourier expansion of an error between the determined light emission waveform and a target light emission waveform defined by the original frame data corresponding to the determined light emission waveform;

assigning weights to Fourier components of the error to add up the Fourier components of the error;

determining a light emission waveform, performing Fourier expansion of an error and assigning weights to Fourier components to add up the Fourier components more than once producing calculated sum values while changing a value of the display frame data of the current frame in each time;

comparing the calculated sum values; and setting display frame data of the current frame as data practically used for displaying the current frame, the display frame data corresponding to a minimum sum value.

2. The data conversion method according to claim 1, wherein the weight of each Fourier component is set individually for each light emission color of a display element.

3. The data conversion method according to claim 1, wherein the weight of Fourier component, of a frequency above a flicker frequency, is set to "0".

4. The data conversion method according to claim 1, wherein a period of each display frame is different from a period of each original frame, comprising;

a current frame and a previous frame and a target gradation waveform defined by original frame data corresponding to the gradation waveform; and setting the display frame data of the current frame so that a sum of error components, with respective weights that are obtained by weighting each Fourier component, is minimized.

5. The data conversion method according to claim 4, wherein the Fourier expansion is performed for each time range having a unit of the display frame period.

6. The data conversion method according to claim 4, wherein the Fourier expansion is performed for each time range having a unit of the original frame period.

7. The data conversion method according to claim 1, wherein the target light emission waveform is an interpolation waveform obtained by linear approximation of a transition of discrete target light emission values in each original frame.

8. The method as recited in claim 1, further comprising weighting the difference components responsive to human eye frequency sensitivity.

9. A data conversion method for displaying an image, comprising conversion of original frame data indicating gradation of a pixel into display frame data defining a light emission timing of a display element in a display frame period, the conversion, comprising:

determining a gradation waveform for plural frames in accordance with display frame data of a current frame and display frame data of a previous frame, the gradation waveform indicating a transition of gradation;

performing Fourier expansion of an error between the determined gradation waveform and a target gradation waveform defined by the original frame data corresponding to the determined gradation waveform;

assigning weights to Fourier components of the error to add up the Fourier components of the error;

determining a gradation waveform, performing Fourier expansion of an error and assigning weights to Fourier components to add up the Fourier components more than once producing calculated sum values while changing a value of the display frame data of the current frame in each time;

comparing the calculated sum values; and setting display frame data of the current frame as data practically used for displaying the current frame, the display frame data corresponding to a minimum sum value.

10. The data conversion method according to claim 9, wherein the weight of each Fourier component is set individually for each light emission color of a display element.

11. The data conversion method according to claim 9, wherein the weight of each Fourier component, of a frequency above a flicker frequency, is set to "0".

12. The data conversion method according to claim 9, wherein the display frame period is different from the original frame period.

13. The data conversion method according to claim 12, wherein the Fourier expansion is performed for each time range having a unit of the display frame period.

14. The data conversion method according to claim 12, wherein the Fourier expansion is performed for each time range having a unit of the original frame period.

15. The data conversion method according to claim 9, wherein the target gradation waveform is an interpolation waveform obtained by linear approximation of a transition of discrete target gradation values in each original frame.

16. The method as recited in claim 9, further comprising weighting the difference components responsive to human eye frequency sensitivity.

17. A display device expressing gradation of original frame data by controlling a light emission timing of a display element in accordance with display frame data, the device comprising:

an original frame memory memorizing original frame data of at least one frame;

a display frame memory memorizing display frame data of at least one frame;

a data converting circuit outputting data corresponding to an input data value as display frame data of an n-th frame, responding to an input of original frame data of the n-th frame, original frame data of at least an (n−1)th frame from the original frame memory and display frame data of at least an (n−1)th frame from the display frame memory, wherein the display frame data outputted by the data converting are prepared by:

determining a light emission waveform for plural frames in accordance with display frame data of a current frame and a display frame data of a previous frame;

performing Fourier expansion of an error between the determined light emission waveform and a target light emission waveform defined by the original frame data corresponding to the determined light emission waveform;

assigning weights to Fourier components of the error to add up the Fourier components of the error;

determining a light emission waveform, performing Fourier expansion of an error and assigning weights to Fourier components to add up the Fourier components more than once producing calculated sum values while changing a value of the display frame data of the current frame in each time;

comparing the calculated sum values; and setting the display frame data of the current frame as data practically used for displaying the current frame, the display frame data corresponding to a minimum sum value.

18. A display device expressing gradation of original frame data by controlling a light emission timing of a display element in accordance with display frame data, the device comprising:

an original frame memory memorizing original frame data of at least one frame;

a display frame memory memorizing display frame data of at least one frame;

a data converting circuit outputting data corresponding to an input data value as display frame data of the n-th frame, responding to an input of original frame data of the n-th frame, original frame data of at least an (n−1)th frame from the original frame memory and display frame data of at least an (n−1)th frame from the display frame memory, wherein the display frame data outputted by the data converting circuit are prepared by:

determining a gradation waveform for plural frames in accordance with display frame data of a current frame and display frame data of a previous frame, the gradation waveform indicating a transition of gradation;

performing Fourier expansion of an error between the determined a gradation waveform and a target gradation waveform defined by the original frame data corresponding to the determined gradation waveform:

assigning weights to Fourier components of the error to add up the Fourier components of the error;

determining gradation waveform, performing Fourier expansion of an error and assigning weights to Fourier components to add up the Fourier components more than once producing calculated sum values while changing a value of the display frame data of the current frame in each time;

comparing the calculated sum values; and setting, display frame data of the current frame as data practically used for displaying the current frame, the display frame data corresponding to a minimum sum value.

19. A PDP display control method, comprising converting original frame data indicating gradation of a pixel into display frame data defining light emission timing of a display element in a display frame period, comprising:

determining a light emission timing length waveform having at least three curve points from display frame data containing a current frame (n), an immediately prior frame (n−1) and a frame immediately prior to the immediate prior frame (n−2);

determining a difference between the light emission timing length waveform and a target light emission timing length waveform having at least three curve points;

performing Fourier expansion of the difference producing difference components; and setting display frame timing length data of the current frame so that a sum of the difference components is minimized.

20. The method as recited in claim 19, further comprising weighting the difference components responsive to human eye frequency sensitivity.

21. A data conversion method for displaying an image, comprising:

converting original frame data indicating pixel gradation into display frame data defining a light emission timing of a display element in a display frame period, comprising:

determining a first light emission luminance waveform having at least three points in original display frame data containing a current frame and a previous frame;

performing Fourier expansion of an error between the first light emission luminance waveform and a second light emission luminance waveform having at least three points corresponding to the first light emission luminance waveform; and setting the display frame luminance data of the current frame where a sum of error components, with respective weights obtained by weighting each Fourier component, is minimized.

22. A data conversion method for displaying an image, comprising:

converting original frame data indicating pixel gradation into display frame data defining a light emission timing of a display element in a display frame period, comprising:

determining a first light emission total display period length waveform having at least three points in original display frame data containing a current frame and a previous frame;

performing Fourier expansion of an error between the first light emission total display period length waveform and a second light emission total display period length waveform having at least three points corresponding to the first light emission total display period length waveform; and setting the display frame total display period length data of the current frame where a sum of error components, with respective weights obtained by weighting each Fourier component, is minimized.

23. A display control method, comprising:

creating a table that determines a new light emission pattern from inputs for a light emission pattern of a past frame and a display graduation level;

obtaining a light emission pattern of a past frame and a display graduation level;

accessing the table with the light emission pattern of the past frame and the display graduation level; and outputting the new light emission pattern.

* * * * *